US007383981B2

(12) United States Patent
Boggs

(10) Patent No.: US 7,383,981 B2
(45) Date of Patent: Jun. 10, 2008

(54) MULTIPLE INDICATOR MEANS FOR RECEPTACLE

(76) Inventor: Gene Boggs, 6225 A.E. Lewis St., Ashland, KY (US) 41102

( * ) Notice: Subject to any disclaimer, the term of this patent is extended or adjusted under 35 U.S.C. 154(b) by 0 days.

(21) Appl. No.: 11/460,460

(22) Filed: Jul. 27, 2006

(65) Prior Publication Data

US 2008/0035721 A1 Feb. 14, 2008

(51) Int. Cl.
*A47G 29/12* (2006.01)

(52) U.S. Cl. ..... 232/34

(58) Field of Classification Search ..... 232/35, 232/34, 17; 116/293, 300, 301, 316, 318; D99/29–32

See application file for complete search history.

(56) References Cited

U.S. PATENT DOCUMENTS

| | | | | | |
|---|---|---|---|---|---|
| 1,543,072 | A | * | 6/1925 | Fenner | 232/34 |
| 1,929,965 | A | * | 10/1933 | Black et al. | 232/35 |
| 2,654,534 | A | * | 10/1953 | van Meter | 232/34 |
| 2,670,897 | A | * | 3/1954 | Gagnon | 232/35 |
| 3,013,715 | A | * | 12/1961 | Ferenci | 232/35 |
| 3,392,911 | A | * | 7/1968 | Clark | 232/35 |
| 3,467,303 | A | * | 9/1969 | Saatzer | 232/35 |
| 3,586,235 | A | * | 6/1971 | Fishel | 232/45 |
| 3,648,924 | A | * | 3/1972 | Burns | 232/35 |
| 4,147,292 | A | | 4/1979 | Fisher | |
| 4,290,549 | A | * | 9/1981 | Getz, Jr. | 232/35 |
| 4,365,740 | A | | 12/1982 | Whitley et al. | |
| 4,805,834 | A | | 2/1989 | Saba | |
| 4,883,223 | A | | 11/1989 | Taniguchi | |
| 5,082,170 | A | | 1/1992 | Goss | |
| 5,094,386 | A | | 3/1992 | Tabacco | |
| 5,119,986 | A | * | 6/1992 | Kobilarcik et al. | 232/35 |
| 6,293,461 | B1 | | 9/2001 | Rivers | |

* cited by examiner

*Primary Examiner*—William L. Miller
(74) *Attorney, Agent, or Firm*—Waters Law Office; Robert R. Waters; Olen L. York, III

(57) ABSTRACT

An indicator apparatus for a receptacle comprises a first indicator and a second indicator, the first indicator and the second indicator mounted to the receptacle in an adjacent relationship. Each one of the indicators is rotatable between an up position and a down position. At least one of the indicators comprises urging element for urging one or both of the indicators between the respective positions.

15 Claims, 3 Drawing Sheets

MULTIPLE INDICATOR MEANS FOR RECEPTACLE

RELATED U.S. APPLICATION DATA

Not applicable.

BACKGROUND OF THE INVENTION

1. Field of the Invention

The present invention generally relates to an indicator for a container. More specifically, the present invention relates to an indicator for a mailbox.

2. Description of the Related Art

Postal mailboxes, and the like, typically include at least one means for indicating that outgoing mail is contained within the mailbox, which is advantageous for pick-up of outgoing mail by mail carriers even when the sender has no in-coming or arriving mail. Usually, means for indicating such outgoing mail is in the form of a rotatable flag or arm.

There have been many attempts and improvements of mailboxes, including the use of additional flags or arms for indicating the arrival of in-coming mail. The use of indicator means for communicating to the addressee that in-coming mail is present in the mailbox is particularly advantageous for those that do not want to go out into inclement weather to check the mailbox, to those that are injured or may be elderly that may be experiencing difficulty in moving from one point to another.

References considered related and relevant to the present invention include disclosures concerning in-coming mail indicator flags utilized in combination with the mailbox door, such as U.S. Pat. No. 6,293,461 (to Rivers), U.S. Pat. No. 5,094,386 (to Tabacco), U.S. Pat. No. 4,805,834 (to Saba), U.S. Pat. No. 4,365,740 (to Whitley et al.) and U.S. Pat. No. 4,147,292 (to Fisher). Of particular relevance is Rivers, which discloses a two flag system utilizing a handle assembly (50) and a control member (52) to flip the outgoing mail indicator (18) to a horizontal position and to urge the in-coming mail indicator (16) to a vertical position. However, Rivers fails to disclose a two-indicator system as described herein.

Other references considered related in disclosing multiple flags include U.S. Pat. No. 5,082,170 (to Goss) and U.S. Pat. No. 4,883,223 (to Taniguchi). Goss discloses the addition of a second flag non-communicative with the main flag. Taniguchi discloses a two-flag indicator system with the two flags mounted on opposite sides of the mailbox structure.

At present, most attempts in this art have provided convoluted mechanical devices that are unsightly and require too much deviation from the standard practice utilized by addressees and mail carriers alike. The present invention takes into consideration the convenience and ease of operating the mailbox or receptacle in the traditional manner while offering greater features and benefits to the users. The present invention fulfills a need in the art in furnishing an apparatus and/or system having multiple indicator means on a receptacle designating the contents within the receptacle as out-going and/or in-coming in a manner that is simple to assemble and simple to use.

SUMMARY OF THE INVENTION

In one embodiment of the present invention, an indicator apparatus for a receptacle is disclosed, the apparatus comprising first indicator means and second indicator means, the first indicator means and the second indicator means mounted to the receptacle in an adjacent relationship. Each one of the indicator means is rotatable between an up position and a down position. At least one of the indicator means comprises means for urging one or both of the indicator means between the respective positions.

In another embodiment of the present invention, an indicator system for attachment to a mailbox is disclosed, the system comprising indicator means for representing in-coming mail and means for urging the indicator means between an up position and a down position. The system also includes means for spacing the indicator means and the outgoing mail flag. In addition, means for urging the outgoing mail flag is provided. Each one of the urging means for urging one or both of the indicator means and/or the outgoing mail flag.

In another embodiment of the present invention, a mailbox is disclosed, the mailbox comprising a housing retaining inserted mail, and first indicator means and second indicator means. Each one of the indicator means is mounted to a sidewall of the housing, the first indicator means in spaced relationship to the second indicator means. Each one of the indicator means is rotatable between an up position and a down position. Each one of the indicator means comprising means for urging the indicator means between the respective positions, and each one of the urging means for urging one or both of the indicator means. The mailbox may include a pedestal or column for securing the mailbox at a specified height above the ground surface.

In each of the aforementioned embodiments described above, it is envisioned that each embodiment may further comprise additional elements, features and benefits, including a spacer disposed between the first indicator means and the second indicator means. Also included is the designation of one of the indicator means representing out-going mail and the remaining indicator means representing in-coming mail. It is also envisioned that at least one of the indicator means comprises indicia, and alternatively, that each one of the indicator means comprises indicia, the indicia of one indicator means differing from the indicia of the other indicator means. It is also envisioned that each one of the indicator means comprises an arm, wherein each one of the arms comprises a flag disposed at the distal end of the arm.

It is further envisioned that the indicator means may have a variety of orientations, wherein the first indicator means comprises urging means mounted to a posterior side of the first indicator means, the urging means elongated to traverse the width occupied by the first indicator means and the second indicator means so as to concurrently urge the first indicator means and the second indicator means from a "DOWN" position to an "UP" position. It is also envisioned that the second indicator means comprises urging means mounted to an anterior side of the second indicator means, the urging means elongated to traverse the width occupied by the first indicator means and the second indicator means so as to concurrently urge the first indicator means and the second indicator means from an "UP" position to a "DOWN" position. Alternatively, it is also envisioned that the second indicator means comprises urging means mounted to a posterior side of the second indicator means, the urging means elongated to traverse the width occupied by the first indicator means and the second indicator means so as to concurrently urge the first indicator means and the second indicator means from a "DOWN" position to an "UP" position.

As discussed above, the method and/or device of the present invention overcomes the disadvantages inherent in the prior art methods and devices. In this respect, before explaining at least one embodiment of the present invention in detail, it is to be understood that the invention is not limited in its application to the details of construction and to the arrangement of the components or elements set forth in the following description or as illustrated in the drawings. The invention is capable of other embodiments and of being practiced and carried out in various ways. Also, it is to be understood that the phraseology and terminology employed herein are for the purpose of description and should not be regarded as limiting the scope of the invention.

Accordingly, those skilled in the art will appreciate that the conception upon which this invention is based may readily be utilized as a basis for the design of other structures, methods, and systems for carrying out the purpose or purposes of the present invention. Therefore, it is important that the claims be regarded as including such equivalent constructions insofar as they do not depart from the spirit of the present invention.

Furthermore, the purpose of the foregoing "Abstract" is to enable the U.S. Patent and Trademark Office and the public, generally, and especially including the practitioners in the art who are not familiar with patent or legal terms or phraseology, to determine quickly from a cursory inspection, the nature and essence of the technical disclosure of the application. The "Abstract" is neither intended to define the invention of the application, nor is it intended to be limiting to the scope of the invention in any way. It is intended that the application is defined by the claims appended to this application.

BRIEF DESCRIPTION OF THE DRAWINGS

Additional utility and features of the invention will become more fully apparent to those skilled in the art by reference to the following drawings, which illustrate the primary features of the preferred embodiment and numerous alternative embodiments.

DETAILED DESCRIPTION OF THE EXEMPLARY EMBODIMENTS

The detailed description set forth below is for preferred embodiments and is intended to explain the present invention. It is to be understood that a variety of other arrangements are also possible without departing from the spirit and scope of the present invention.

In general, the present invention may be depicted and is envisioned as being appropriate in several various embodiments. In particular, the present invention may be characterized as an indicator apparatus or system for a receptacle comprising first indicator means and second indicator means to visually represent the presence of out-going mail and/or in-coming mail. In another embodiment, the present invention may be characterized as an indicator system attached to an existing mailbox, the apparatus comprising indicator means to visually represent the presence of in-coming mail to the mail carrier, the apparatus coupled to the existing indicator means for out-going mail. Another embodiment of the present invention is characterized as a mailbox comprising a housing for retaining mail and first indicator means and second indicator means for visually representing the presence of out-going mail and in-coming mail. Each of these embodiments, and additional embodiments, are discussed in greater detail below.

Figure 1:
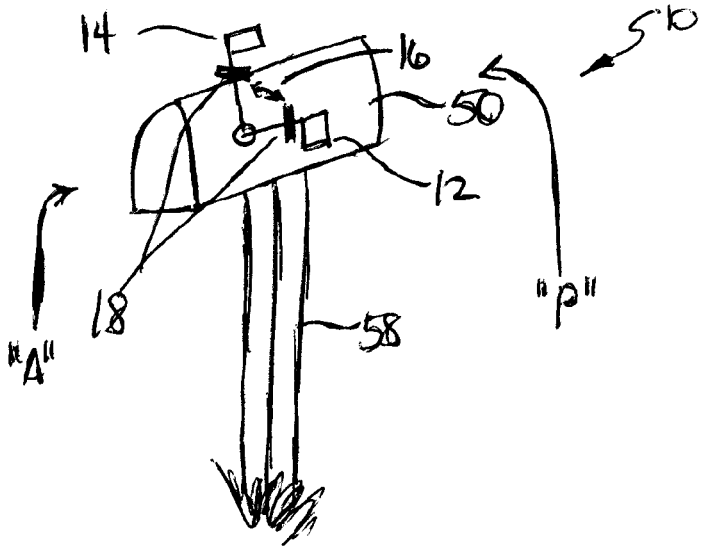
FIG. 1 is a perspective view of a mailbox on a pedestal and having the multiple indicator apparatus or system attached to the mailbox.
Figure 2:
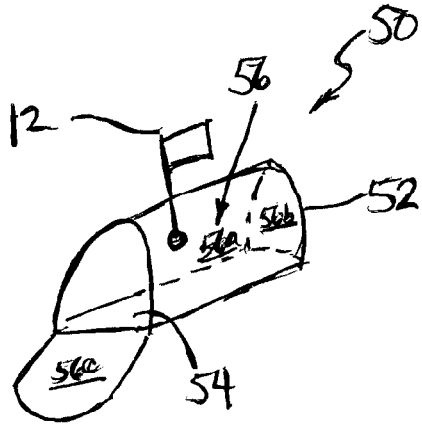
FIG. 2 is a perspective view of a receptacle or mailbox.
Figure 3:
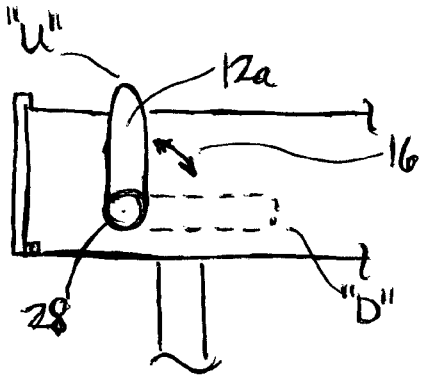
FIG. 3 is a side view of one embodiment of an indicator means comprising an arm.
Figure 4:
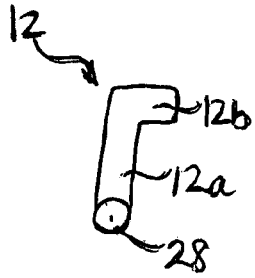
FIG. 4 is a side view of another embodiment of the indicator means comprising an arm with a flag at the distal end.
Figure 5:
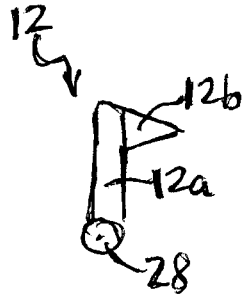
FIG. 5 is a side view of another embodiment of the indicator means comprising an arm with a pennant at the distal end.
Figure 6:
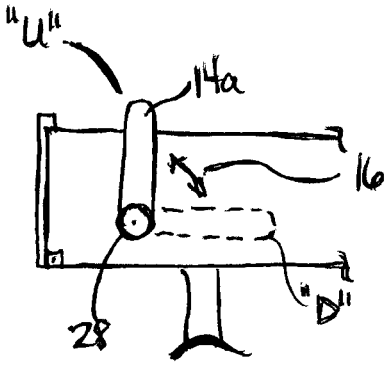
FIG. 6 is a side view of another embodiment of another indicator means comprising an arm.
Figure 7:
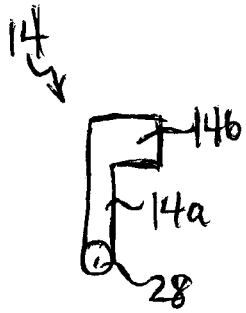
FIG. 7 is a side view of another embodiment of the indicator means of FIG. 6 comprising an arm with a flag at the distal end.
Figure 8:
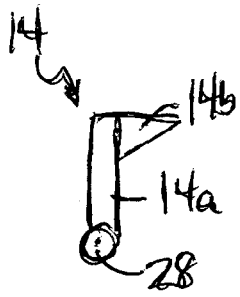
FIG. 8 is a side view of another embodiment of the indicator means of FIG. 6 and FIG. 7 comprising an arm with a pennant at the distal end.

Referring now to FIG. 1 through FIG. 8, an indicator apparatus 10 is depicted in accordance with one embodiment of the present invention, with the apparatus 10 attached or coupled to a receptacle 50, such as a mailbox or collection bin as only two examples. As but one example, FIG. 1 depicts the apparatus 10 having indicator means 12 that visually representing the presence of out-going mail for the mail carrier to collect, such as an arm 12*a*, an arm 12*a* having a flag or pennant 12*b*, or other means for visually representing out-going mail. The apparatus 10 also comprises indicator means 14 visually representing the presence of in-coming mail or mail delivered to the addressee by the mail carrier, which may be similarly configured to indicator means 12, such as an arm 14*a*, an arm 14*a* having a flag or pennant 14*b*, or other means for visually representing in-coming mail. Each indicator means 12 and 14 is rotatable between an "UP" position "U" and a "DOWN" position "D", the rotation or movement indicated by the bidirectional arrow 16. The apparatus 10 comprises urging means 18 for urging the indicator means 12 and/or 14 between positions "U" and "D". The respective urging means are denoted as 18*a* (for indicator means 12) and 18*b* (for indicator means 14).

As indicated previously, one or both of the indicator means 12 and 14 may have a variety of forms, including an arm (12*a* and/or 14*a*), an arm having a flag or pennant (12*b* and/or 14*b*) formed at the free (distal) end of the arm 12*a* or 14*a*, an arm having a flag or pennant and further having indicia 20 affixed near or on the flag or pennant, or an arm having indicia 20 affixed to the free (distal) end of the arm 12*a* or 14*a*. Urging means 18 may be coupled to the anterior side "A" or the posterior side "P" of either the indicator means 12 and/or 14.

It is envisioned in one embodiment that the first indicator means 12 comprises urging means 18*a* mounted to a posterior side P of the first indicator means 12, the urging means 18*a* elongated to traverse the width "W" occupied by the first indicator means 12 and the second indicator means 14 so as to concurrently urge the first indicator means 12 and the second indicator means 14 from a "DOWN" position to an "UP" position. It is envisioned in another embodiment that the second indicator means 14 comprises urging means 18*b* mounted to an anterior side "A" of the second indicator means 14, the urging means 18*b* elongated to traverse the width "W" occupied by the first indicator means 12 and the second indicator means 14 so as to concurrently urge the first indicator means 12 and the second indicator means 14 from an "UP" position to a "DOWN" position. It is also envisioned in another embodiment that the second indicator means 14 comprises urging means 18*b* mounted to a posterior side "P" of the second indicator means 14, the urging means 18*b* elongated to traverse the width "W" occupied by the first indicator means 12 and the second indicator means 14 so as to concurrently urge the first indicator means 12 and the second indicator means 14 from a "DOWN" position to an "UP" position.

Indicator means 12 and 14 may be coupled or affixed to the receptacle 50 in a variety of manners, including the standard coupling used on many of the commercially available receptacles modified to accept a spacing means 25 (described below) or the use of a mechanical fastener or connector 26, such as a threaded or non-threaded bolt, or other means having an end or margin that prevents the outside means 12 or 14 from disengaging the fastener 26. For instance, the outside indicator means 12 or 14 may have a fastener or stem integral at pivot 28 (which is provided on each means 12 and 14) that is coupled with the pivot 28 of the other means 12 or 14. It is envisioned that indicator means 12 and 14 are separately and independently rotatable if one means 12 or 14 is selected for rotation or movement and the other means 12 or 14 is not selected, while also being capable of concurrent rotation or movement in accordance with the description provided relative to the means 12 and 14 and the urging means 18.

Figure 11:
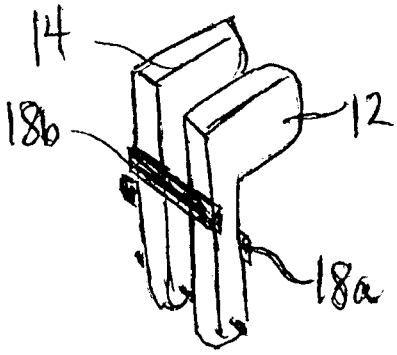
FIG. 11 is a perspective view of the indicator means with urging means, one urging means mounted to the anterior side of an indicator means (14) and the other urging means mounted to the posterior side of the other indicator means (12)
Figure 12:
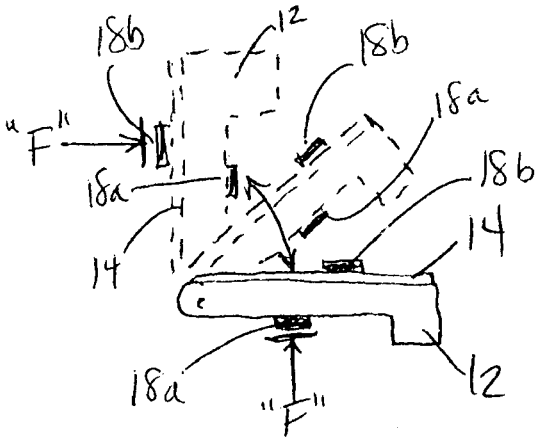
FIG. 12 is a side view of FIG. 11, wherein force "F" is applied to either of the urging means (18*a* or 18*b*) and allows for raising or lowering of the indicator means concurrently or separately as desired.
Figure 13:
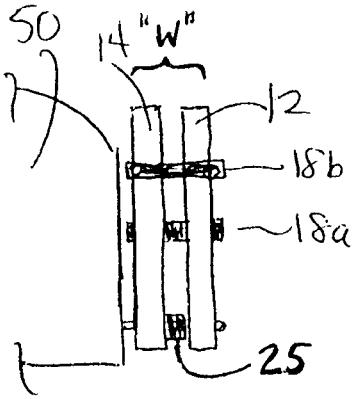
FIG. 13 is a front (anterior) view of the indicator means with urging means and spacing means.
Figure 14:
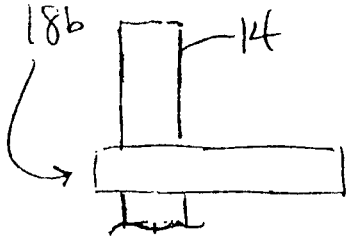
FIG. 14 is a front (anterior) view of urging means mounted to indicator means, wherein the other indicator means and urging means are removed for clarity.

Urging means 18 may comprise a variety of devices or configurations, including an elongated band, rod or cylinder, or a plurality of bands, rods or cylinders, or other devices/elements that may be utilized in the manner described above for raising and/or lowering the first indicator means and the second indicator means, separately or concurrently. These various devices may have a variety of geometric forms, such as orthogonal or prolated. In the embodiments depicted in FIG. 11 through FIG. 18, urging means 18 are depicted as a band or bands. In the embodiment depicted in FIG. 11, urging means 18*a* is mounted to one of the indicator means 12 and urging means 18*b* is mounted to the other indicator means 14. As the urging means 18*a* is urged upward, concurrently urging the indicator means 12 upward, the indicator means 12 engages and then urges urging means 18*b* of the indicator means 14, thereby concurrently urging the indicator means 12 and 14 to the "UP" position. Likewise, and in reverse, as the urging means 18*b* of indicator means 14 is urged downward, concurrently urging the indicator means 14 downward, the urging means 18*b* engages and then urges indicator means 12, thereby concurrently urging the indicator means 14 and 12 to the "DOWN" position. In the embodiment depicted in FIG. 19, urging means 18 comprises a linearly elongated rod or cylinder 18'depending from the free/distal end of the arm 12*a* or 14*a* of one of the indicator means 12 or 14. The rod or cylinder 18' is coupled or affixed at one end to the arm 12*a* or 14*a* and has an opposing free/distal end that is not coupled or affixed. The free/distal end engages the posterior side of the other indicator means 12 or 14 so that as the indicator means 12 or 14, with the rod or cylinder 18"depending therefrom, is urged into rotation, the rod or cylinder 18" engages and urges the other indicator means 12 or 14 into similar rotation for moving between the "U" and "D" positions.

Figure 17:
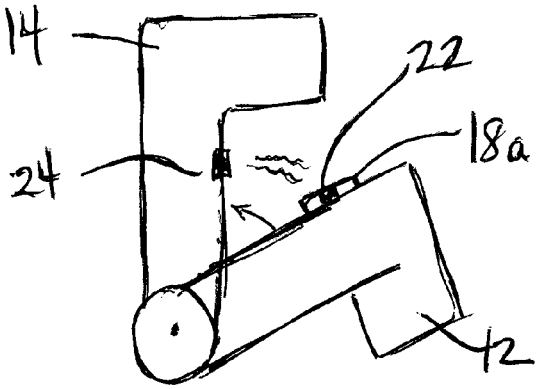
FIG. 17 is a side view of another embodiment of urging means, wherein the band comprises a magnet that is attracted to a magnet coupled to the other indicator means.
Figure 18:
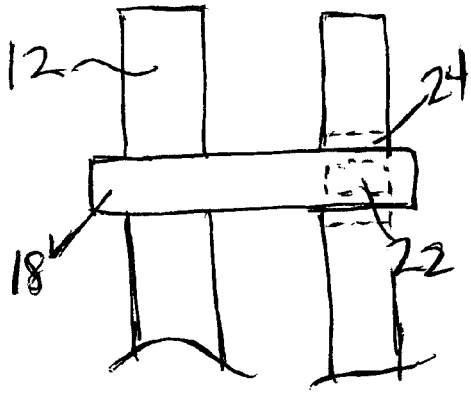
FIG. 18 is a rear (posterior) view of FIG. 17.
Figure 19:
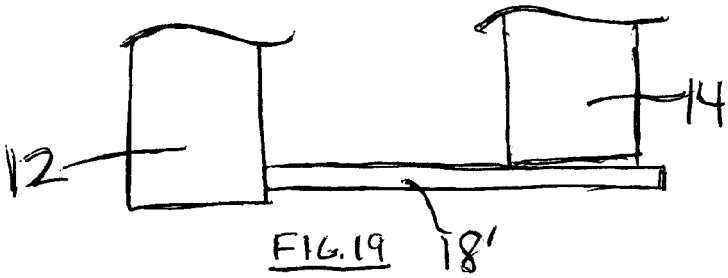
FIG. 19 is a rear (anterior) view of another embodiment of the urging means, comprising an elongated rod or cylinder depending from indicator means and engaging the other indicator means.

Additional variations of urging means 18 includes the use of a single band 18' having a magnet 22 coupled or formed therein and communicating with a magnet 24 coupled or formed in the indicator means 12 or 14, as depicted in FIG. 17 and FIG. 18. The magnet 22 is attracted to the magnet 24, thus coupling the indicator means 12 and 14 in a magnetic manner for raising or lowering the means 12 and 14. If the indicator means 12 or 14 having the magnet 22 must be rotated free from the indicator means having magnet 24, then the magnetic coupling may be easily broken, as it is envisioned that the magnetic force and attraction between magnets 22 and 24 are sufficient to attract but not difficult to disengage.

Figure 15:
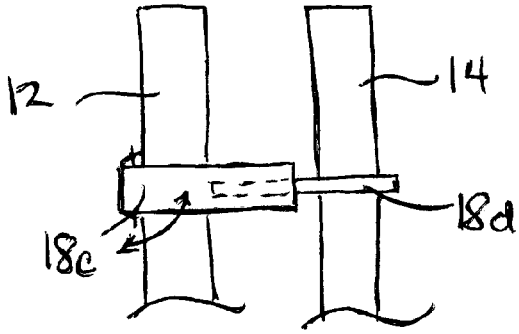
FIG. 15 is a rear (posterior) view of another embodiment of the urging means, comprising multiple bands, wherein one band 18*c* is rotatable to engage the other band 18*d* and urge the rotation of the respective indicator means.
Figure 16:
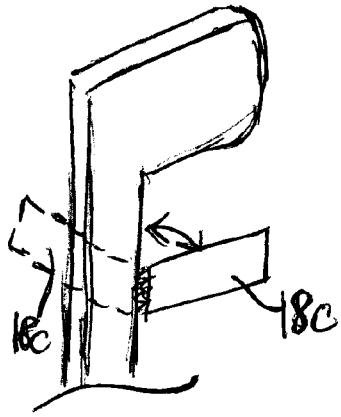
FIG. 16 is a perspective view of FIG. 16.

Another variation includes the use of a plurality of bands, depicted as two separate bands 18*c* and 18*d*, as depicted in FIG. 15 and FIG. 16. The bands 18*c* and 18*d* may be coupled, mounted or affixed to the indicator means 12 or 14 at either the anterior side or posterior side. The band 18*c* is rotatable in a plane perpendicular to the indicator means 12 and/or 14. The band 18*d* is fixed and stationary. The band 18*c* may be rotated to engage or disengage the band 18*d*. To raise or lower the indicator means 12 and 14 concurrently, the band 18*c* is rotated to engage band 18*d* and is either pulled toward the anterior portion of the receptacle if the bands 18*c* and 18*d* are mounted at the posterior side of the means 12 and 14 (raising the means 12 and 14), or pushed toward the posterior portion of the receptacle if the bands 18*c* and 18*d* are mounted on the anterior side of the means 12 and 14 (lowering means 12 and 14). Once the indicator means 12 and 14 are raised or lowered (as the case may be), the indicator means 12 or 14 possessing band 18*c* may be rotated to a reverse position since the bands 18*c* and 18*d* are not affixed in a permanent manner. For instance, in an embodiment in which the bands 18*c* and 18*d* are mounted at the posterior side to the indicator means 12 and 14, a user may insert out-going mail into the receptacle, and then raise both means 12 and 14 by rotating the band 18*c* into position to engage the other indicator means 12 or 14, and then raise the means by simple rotation of the means 12 and 14 about its pivot 28. When the mail carrier collects the out-going mail, any in-coming mail is inserted therein, and the mail carrier may lower the indicator means 12 or 14 as normal without also lowering the in-coming indicator means 12 or 14. If there is no in-coming mail, both means 12 and 14 may be lowered without much effort. It is also envisioned that the bands 18*c* and 18*d* may incorporate the magnets 22 and 24 as described above, operating in a similar manner as described above.

Figure 9:
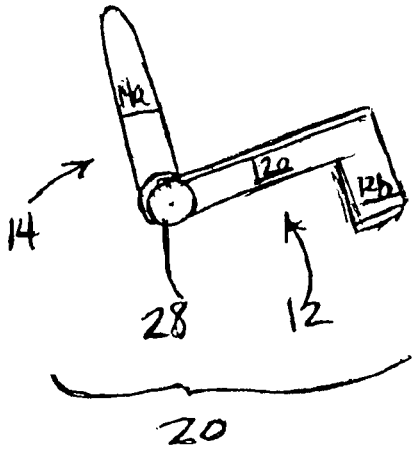
FIG. 9 is a perspective view of the indicator means, one comprising an arm and the other indicator means comprising an arm with a flag at the distal end, the indicator means differentiated by the physical shape serving as visual indicia.
Figure 10:
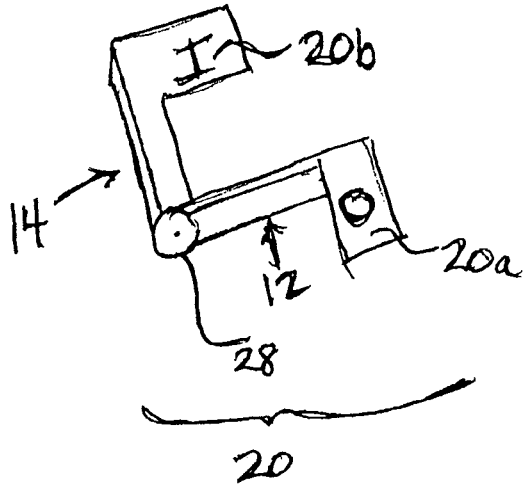
FIG. 10 is a perspective view of the indicator means comprising two indicator arms with flags at the distal ends and with the flags having distinctly different indicia.

The indicator means 12 and/or 14 may comprise indicia 20. In one embodiment, it is envisioned that at least one of the indicator means 12 or 14 comprises indicia 20 so that the indicator means 12 and 14 may be visually differentiated from a distance. For instance, and as depicted in FIG. 9, indicator means 12 (depicted as a standard out-going mail flag) and indicator means 14 (depicted as a linearly elongated arm 14*a*) are differentiated by indicia 20, in which indicia 20 comprises the physical distinction between the two means 12 and 14, namely the physical shape of the respective means 12 and 14. The means 12 and 14 could have the reverse configuration (12 comprising an arm; 14 comprising a flag), or some other variation, such as the use of licensed trademarks, including professional and college sports team logos, fictional characters or other similar type of indiciia. In another embodiment, as in FIG. 10, each of the indicator means 12 and 14 comprise indicia 20*a* and 20*b*, respectively, wherein the indicia 20*a* of one indicator means 12 differs from the indicia 20*b* of the other indicator means 14 to visually differentiate the indicator means 12 and 14, and may include the variations discussed above with regard to licensed trademarks and the like.

The apparatus 10 may further comprise spacing means 25 disposed between the indicator means 12 and 14 so as to provide sufficient space between the indicator means 12 and 14 for ease of movement and use. It is envisioned that spacing means 25 may include a variety of devices, such as variously sized mechanical washers, bushings, threaded nuts, or other similar devices capable of placing the indicator means 12 and 14 in spaced relationship.

In another embodiment of the present invention, an indicator system for coupling or attachment to a mailbox is described, envisioned as retrofitting an existing mailbox or receptacle 50 with an additional indicator means 14 visually representing in-coming mail. The system comprises indicator means 14 for representing in-coming mail. The system also comprises urging means 18 associated with the indicator means 14 for allowing the rotation of the indicator means between "U" and "P" positions. The system may also comprise a spacing means 25 for disposition between the in-coming mail indicator means 14 and the out-going mail indicator means 12 (depicted as a mail flag). The system may also include urging means 18 for coupling or attachment to the out-going mail indicator means 12. This system includes all the variations and embodiments described above related to the apparatus 10.

In another embodiment of the present invention, a mailbox 50 is described as comprising a housing 52 that retains mail inserted by the addressee or the mail carrier. The housing 52 may have a variety of configurations, so long as the configuration is in accordance with U.S. Postal Service regulations regarding mailboxes 50. As is standard, a mailbox 50 will generally comprise of a floor 54 having upstanding walls 56 along all sides thereof, usually in the form of a curvilinear sidewall 56*a* (although orthogonally positioned walls are also envisioned), a posterior end wall 56*b* and a pivotal door 56*c* opposite to the end wall 56*b*, thereby forming an enclosure over the floor 54 of the mailbox 50. The mailbox 50 may be mounted to an existing free-standing structure, or may also include a pedestal or column 58 that may be inserted into the surface (such as the ground or driveway). The mailbox 50 of the present invention comprises a first indicator means 12 and second indicator means 14, each one of the indicator means 12 and 14 mounted to a sidewall 56*a* of the housing 52. The first indicator means 12 is in spaced relationship to the second indicator means 14, which may be achieved by the spacing means 20 or spacer explained above. Each one of the indicator means 12 and 14 is rotatable between "U" and "P" positions. Each one of the indicator means 12 and 14 comprises urging means 18 for urging the indicator means 12 and 14 between the respective positions. Each one of the urging means 18 may urge one or both of the indicator means 12 and/or 14 into rotation about pivot 28. The mailbox 50 described above includes all the variations and embodiments described above related to the apparatus 10 and the system 100, respectively.

It is envisioned that the materials that may be used for one, some or all the element so the various embodiments described above may include plastic, ceramic, metal, wood, or a combination thereof, to achieve the desired end product and results derived therefrom.

The apparatus or system as described above is intended to provide at least a second means of visual indication, usually representing the presence (or absence) or in-coming mail for receipt by the addressee(s) of a particular mailbox. The additional indicator means (generally denoted here as reference character 14) may be a separate apparatus that is retrofitted to an existing mailbox and out-going mail indicator means, or may be an apparatus that includes a first indicator means and a second indicator means that is coupled to a mailbox, or may be an unified mailbox structure having first and second indicator means coupled thereto.

To use the apparatus or system described above, once the additional indicator means 14 is installed, along with the urging means 18 for one or both of the indicator means 12 and 14, the user may raise both indicator means 12 and 14 concurrently by placing a force "F" on urging means 18*a* coupled or mounted to indicator means 12 to visually indicate to the mail carrier that out-going mail is present. Because urging means 18*a* is affixed to indicator means 12 and traverses the width of indicator means 12 and 14, urging means 18*a* will engage both indicator means 12 and 14 and urge the indicator means 12 and 14 in a rotatable motion between "D" and "U". The mail carrier will collect the out-going mail. If no in-coming mail is inserted into the mailbox 50, the mail carrier may lower both indicator means 12 and 14 by placing a force "F" on urging means 18*b* (if provided), since urging means 18*b* is affixed to indicator means 14 and traverses the width of indicator means 12 and 14, thereby engaging both indicator means 12 and 14 and concurrently urging the means 12 and 14 from "U" to "D". If in-coming mail is present, the mail carrier may lower the indicator means 12 (out-going mail) from "U" to "D" and leave the indicator means 14 (in-coming mail) as a visual indication to the addressee that in-coming mail is deposited in the mailbox 50. If no urging means 18*b* is provided, the mail carrier may lower one or both of the indicator means 12 and/or 14 manually as in the manner described above with lowering indicator means 12 when in-coming mail is present. These same principles are applicable to the other variations described above, although sometimes the reverse manual operations are required.

While the invention has been described by way of example and in terms of several embodiments, it is to be understood that the invention is not limited to the embodiments disclosed herein. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An indicator apparatus for a mailbox, the apparatus comprising:

first indicator means and second indicator means, the first indicator means and the second indicator means mounted to the mailbox in an adjacent relationship;

each one of the indicator means rotatable between an up position and a down position;

at least one of the indicator means comprising means for urging one or both of the indicator means between the up position and the down position;

the urging means mounted to one of the indicator means, the urging means engaging and urging the first indicator means and the second indicator means from the down position to the up position;

the urging means is mounted to the first indicator means a portion of the urging means projecting from a posterior side of the first indicator means, the urging means elongated to traverse the width occupied by the first indicator means and the second indicator means so as to concurrently engage and urge the first indicator means and the second indicator means from the down position to the up position; and the second indicator means comprises urging means mounted to the second indicator means, the urging means elongated to traverse the width occupied by the first indicator means and the second indicator means so as to concurrently engage and urge the first indicator means and the second indicator means from the up position to the down position.

2. The apparatus of claim 1 further comprising a spacer disposed between the first indicator means and the second indicator means.

3. The apparatus of claim 1, wherein one of the indicator means represents out-going mail and the other indicator means represents in-coming mail.

4. The apparatus of claim 3, wherein at least one of the indicator means comprises indicia.

5. The apparatus of claim 3, wherein each one of the indicator means comprises indicia, the indicia of one indicator means differing from the indicia of the other indicator means.

6. The apparatus of claim 1, wherein each one of the indicator means comprises an arm.

7. The apparatus of claim 6, wherein each one of the arms comprises a flag disposed at a distal end of the arm.

8. The apparatus of claim 1, wherein the second indicator means urging means is mounted to a posterior side of the second indicator means.

9. An indicator apparatus for a mailbox, the apparatus comprising:

first indicator means and second indicator means, the first indicator means and the second indicator means mounted to the mailbox in an adjacent relationship;

the first indicator means and the second indicator means separately or collectively rotatable between an up position and a down position;

first urging means mounted to the first indicator means, the first urging means facilitating rotation of the first indicator means;

second urging means mounted to the second indicator means, the second urging means facilitating rotation of the the second indicator means, the second urging means elongated to traverse the aggregate width occupied by the first indicator means and the second indicator means;

wherein, inducing the first urging means upward urges the first indicator means into engagement with the second urging means concurrently urging the first indicator means and the second indicator means to the up position; and wherein, inducing the second urging means or the second indicator means downward urges the second urging means into engagement with the first indicator means concurrently urging the second indicator means and the first indicator means to the down position.

10. The apparatus of claim 9 further comprising a spacer disposed between the first indicator means and the second indicator means.

11. The apparatus of claim 9, wherein one of the indicator means represents out-going mail and the other indicator means represents in-coming mail.

12. The apparatus of claim 11, wherein at least one of the indicator means comprises indicia.

13. The apparatus of claim 11, wherein each one of the indicator means comprises indicia, the indicia of one indicator means differing from the indicia of the other indicator means.

14. The apparatus of claim 9, wherein each one of the indicator means comprises an arm.

15. The apparatus of claim 14, wherein each one of the arms comprises a flag disposed at a distal end of the arm.

* * * * *